US005079985A

United States Patent [19]

Yamaguchi et al.

[11] Patent Number: 5,079,985

[45] Date of Patent: Jan. 14, 1992

[54] KEYBOARD APPARATUS FOR ELECTRONIC KEYBOARD MUSICAL INSTRUMENT

[75] Inventors: Tsutomu Yamaguchi, Kakegawa; Yutaka Tamai; Yoshiaki Shimoda, both of Hamamatsu, all of Japan

[73] Assignee: Kabushiki Kaisha Kawai Gakki Seisakusho, Shizuoka, Japan

[21] Appl. No.: 526,821

[22] Filed: May 22, 1990

[30] Foreign Application Priority Data

| | | | |
|---|---|---|---|
| May 24, 1989 | [JP] | Japan | 1-60129[U] |
| May 24, 1989 | [JP] | Japan | 1-60130[U] |
| May 24, 1989 | [JP] | Japan | 1-60131[U] |
| May 24, 1989 | [JP] | Japan | 1-60132[U] |
| May 24, 1989 | [JP] | Japan | 1-60133[U] |
| May 24, 1989 | [JP] | Japan | 1-60134[U] |

[51] Int. Cl.[5] ..... G10B 1/34

[52] U.S. Cl. ..... 84/719; 84/720; 84/DIG. 7

[58] Field of Search ..... 84/423 R, 433–437, 84/644, 670, 719, 744, 720, 745, DIG. 7

[56] References Cited

U.S. PATENT DOCUMENTS

| | | | |
|---|---|---|---|
| 4,127,051 | 11/1978 | Conklin, Jr. | 84/423 R |
| 4,205,583 | 6/1980 | Absmann | 84/433 |
| 4,217,803 | 8/1980 | Dodds . | |
| 4,873,905 | 10/1989 | Murakami et al. | 84/20 |
| 4,899,631 | 2/1990 | Baker | 84/719 |

FOREIGN PATENT DOCUMENTS 47-36415 9/1972 Japan .

*Primary Examiner*—Stanley J. Witkowski

*Attorney, Agent, or Firm*—Irving M. Weiner; Joseph P. Carrier; Pamela S. Burt

[57] ABSTRACT

A keyboard apparatus for an electronic keyboard musical instrument comprising a wooden key which is swingably supported by a fulcrum on a metallic keyboard chassis and which is returned from its depressed position by returning means, a precisely constructed balance rail of metal or plastic is provided on the metallic keyboard chassis, and the wooden key is directly supported by the balance rail.

9 Claims, 3 Drawing Sheets

KEYBOARD APPARATUS FOR ELECTRONIC KEYBOARD MUSICAL INSTRUMENT

FIELD OF THE INVENTION

This invention relates to a keyboard apparatus, using wooden keys, for an electronic keyboard musical instrument such as electronic piano, electronic organ, and the like.

DESCRIPTION OF THE RELEVANT ART

As this kind of keyboard apparatus, there is conventionally known one, as shown in FIG. 1, in which a wooden balance rail d is mounted on a wooden key bed "a" through a metallic keyboard chassis b and a wooden key frame c. A key f is swingably supported at a fulcrum e on the balance rail d. The depressed key f is returned by a returning means k. The returning means k comprises a plastic lever h which swings about a lever fulcrum g located towards the rear of the key f, a lever weight i of lead and a spring j.

It is preferred that the key f is made of wood because wood has a good feeling generated at the time of touching the key. In the example shown in the figure, the key f swings guided by a front pin m which prevents lateral fluctuations of the key f. The front pin m is embedded in a wooden key frame front rail 1 which has a felt member r for alleviating the shock of the key f. When the key f swings, a screwed type actuator n which is mounted by screwing in the front of the fulcrum e presses a switch o on the key frame which determines the start of sound generation. Aside from the actuator n shown in FIG. 1, which is mounted by penetrating from the bottom surface of the key f towards the upper surface thereof, there is known another type of actuator which is mounted by screwing from the bottom of the key up to an intermediate position thereof so that it does not penetrate to the upper surface.

The lever weight i to be mounted on the lever h of the returning means k is provided to give an inertia at the time when the key f is swung. The lever weight i is either mounted with an adhesive p as shown in FIG. 1 or is fixed to the lever h by providing a pin which penetrates the lever weight i. A key weight or weights q mounted on the key f is also provided to give a similar inertia to the key f, and is normally fixed to the key f with an adhesive.

The keyboard of the keyboard musical instrument comprise white keys and black keys. The key shown in FIG. 1 denotes a white key which swings about the fulcrum e at the bottom portion of the pin s through which the key f is inserted. In FIG. 1 the indication of a black key is omitted, although the figure does depict a fulcrum t at the bottom of a pin u through which the black key would be inserted. The fulcrum t for the black key is located at a position rearwardly of the fulcrum e of the white key.

A key stop w to prevent the key f from swinging upwards is provided on the upper part of the key f by being supported by a support x which extends vertically upwards from the balance rail d through one side of the key f.

In the above-mentioned keyboard apparatus, the key f is supported by the wooden balance rail d which is mounted on the wooden key frame c. Therefore, the position of the fulcrum e is likely to be subject to misalignment due to environmental changes, especially the change in the relative humidity. Due to this misalignment, there is a disadvantage in that the timing for the actuator n to push the switch o varies and, therefore, that an adjustment has to be carried out. In addition, the wooden balance rail d and the key f are relatively poor in fabrication accuracies and are accompanied by changes with the lapse of time. Therefore, it is necessary to perform many adjustments after the musical instrument is assembled.

The adjustment of the timing is carried out by rotating the actuator n from the upper portion or the bottom portion of the key f. In case the actuator n is mounted by penetrating the upper surface of the key f, it has to be mounted in an area rather towards the rear, as indicated by the arrow L, to avoid impairing the beauty of the surface of the key f. Also, in performing such adjustment of the actuator n, since the actuator can be moved only by a very minute adjustment distance, there is a disadvantage in that the adjustment is difficult. The above-mentioned disadvantage may be solved if the actuator n is mounted by screwing from the bottom surface of the key such that it does not penetrate the key up to its upper surface. In such situation another disadvantage will arise, however, because the key f must be taken into pieces for dismounting it from the keyboard apparatus before an adjustment of the actuator n can be made from the bottom side thereof, thus remarkably complicating the adjustment process.

Additionally, since the key f and the lever h of the returning means k are swung relatively vehemently, the key weight q and the lever weight i to be respectively mounted thereon are firmly attached. However, changes in dimensions due to the temperature changes are not the same between the mounting members such as the key f and the lever h and the inertia applying members such as the key weight q and the lever weight i. Consequently, looseness is likely to occur at the points of their mounting. There is a disadvantage in that any such looseness will give rise to abnormal vibrations when the key is swung, resulting in a nuisance to the operation of the musical instrument. In case these inertia applying members are attached with an adhesive, it takes a relatively long time for the adhesive to harden, which results in a disadvantage of prolonged time of manufacturing.

Further, since the key frame front rail 1 is mounted on the side of the key f toward the keyboard chassis b, changes in dimensions are likely to occur depending on the ambient changes, especially the change in the relative humidity. As an example of such changes, the key frame front rail 1, which extends in a direction normal to the surface of FIG. 1, may become undulated. Consequently, the swinging distance between the key f and that upper end of the key frame front rail 1 with which the key f comes into contact varies from key to key. There are, therefore, cases where the switch o of a key f starts operatings in the wrong timing or does not operate at all.

Further, each of the fulcrums for the white keys and the black keys, which constitute the keyboard, is located in the front and the rear positional relationship as shown in FIGS. 2*a* and 2*b*. As shown in FIG. 2*a*, white key f has a long distance A+C from the fulcrum e and therefore gives the operator a feeling of mass during playing. The black key v, on the other hand, has a shorter distance B+C+D from the fulcrum t than that of the white key f, as shown in FIG. 2*b* and therefore can offer a lesser feeling of mass during playing. In addition, the black key v has a smaller switch actuation ratio, i.e., a smaller distance at which the key must be swung in order to actuate the switch o, than that of the white key f. Therefore, there is a disadvantage in that the black key v has a very poor feeling generated at the time of touching the key.

In addition, in order to prevent the key f from swinging upwards, the key stop w is conventionally mounted at a position near the fulcrum e as shown in FIG. 1, or at a position in front of the fulcrum e as shown in FIG. 3. In the former case, if the key f is firmly pressed by the key stop w, the felt z of the key stop w is deformed by that rear portion of the key f which is urged upwards at the rear of the fulcrum e when the key f is depressed. This brings about a disadvantage in that the feeling generated at the time of touching the key is impaired. In the latter case, since the key f is inclined upwards at the front of the fulcrum e, a relatively large space is required above the key f in order to mount the key stop w. This brings about a disadvantage in that the keyboard cannot be contained in a compact manner and therefore that there is poorer freedom of design.

SUMMARY OF THE INVENTION

A first object of this invention is to eliminate the above-mentioned disadvantages associated with the use of the wooden key, thereby providing a keyboard apparatus of an electronic keyboard musical instrument in which the misalignment of the fulcrum is small and its adjustment is easy.

A second object of this invention is to enable easy adjustment of the actuator without impairing the external beauty of the keyboard.

A third object of this invention is to provide a keyboard apparatus of an electronic keyboard musical instrument in which the inertia applying members to be mounted on the returning means do not come loose and in which the manufacturing thereof can be made in a short period of time.

A fourth object of this invention is to eliminate the wrong timing of switch operation or its failure of operation due to the deformation of the key frame front rail.

Still another object of this invention is to improve the feeling generated at the time of touching the black key and to provide a keyboard which can be designed in a compact manner and which can offer a higher freedom in design.

According to the present invention, the first object is attained by providing the following features. Namely, in a keyboard apparatus for an electronic keyboard musical instrument comprising a wooden key which is swingably supported by a fulcrum on a metallic keyboard chassis and which is returned from its depressed position by returning means, a metallic or plastic balance rail is provided on the metallic keyboard chassis, and the wooden key is directly supported by the balance rail.

The second object of this invention is attained by providing the following features. Namely, a switch for actuating the sounding of a key of the electronic keyboard musical instrument is provided on the keyboard chassis, an actuator of screwed construction for pushing the switch by the swinging of the key is screwed to the key in front of the fulcrum of the key, an actuator adjusting window is defined in the key in the width direction thereof, an engaging portion for adjustment is provided at a tip portion of the actuator, and the actuator is mounted by screwing from the bottom portion of the key such that the tip portion of the actuator is exposed through the adjusting window.

The third object of this invention is attained by providing the following features. Namely, an inertia applying member is provided for applying inertia to the key, a box is provided on a mounting member for the inertia applying member, the box containing at least part of the inertia applying member, a plurality of projections are formed on the inertia applying member, a plurality of through holes are provided in the box such that the projections project out of the box, and those portions of the projections which project outside the box through the through holes are subjected to deformation, thereby fixing the inertia applying member to the inside of the box.

The fourth object of this invention is attained by providing the following features. Namely, a front pin is provided on a key frame front rail in front of the fulcrum to prevent the key from laterally fluctuating during swinging thereof, the key frame front rail is fixed to that side of the keyboard chassis which is opposite to the key, and the front pin is extended into the key through the chassis.

Other objects, advantages and salient features of the present invention, including those attained by the constructions of claims 7 and 8, will become apparent from the following detailed description which, when taken in conjunction with the annexed drawings, discloses a preferred embodiment of the invention.

DETAILED DESCRIPTION OF THE PREFERRED EMBODIMENT

Figure 1:
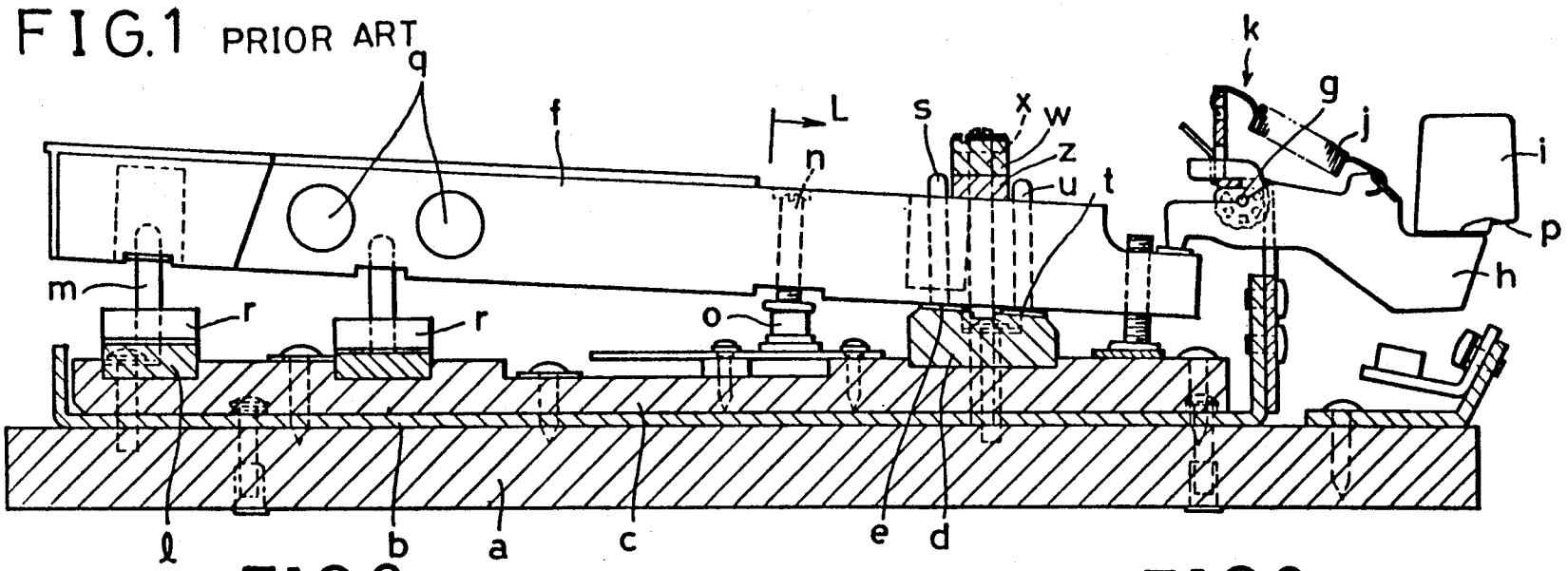
FIG.1 PRIOR ART
FIG. 1 is a side view, partly in section, of a conventional keyboard apparatus for an electronic musical instrument.
Figure 3:
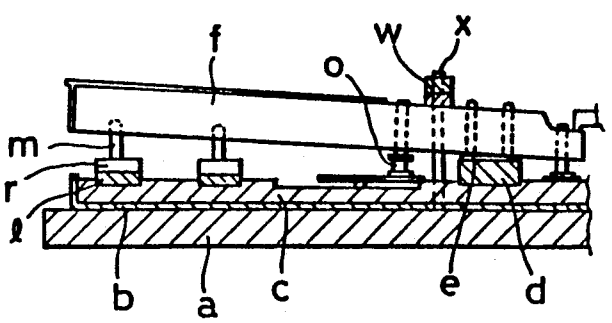
FIG.3 PRIOR ART
FIG. 3 is a general side view of another conventional keyboard apparatus.
Figure 2A:
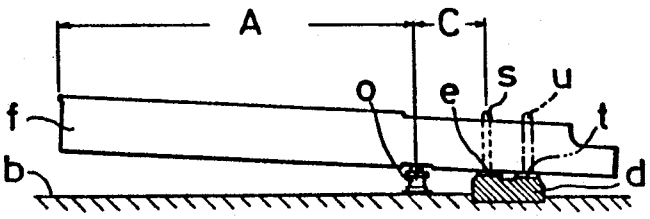
FIG.2a PRIOR ART
FIGS. 2*a* and 2*b* are explanation diagrams of a white key and a black key of a conventional keyboard, respectively.
Figure 2B:
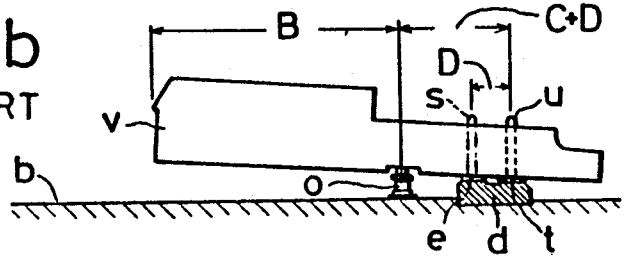
FIG.2b PRIOR ART

An embodiment of this invention as applied to an electronic keyboard musical instrument is explained with reference to FIG. 4. In the figure, numeral 1 denotes a metallic keyboard chassis of the keyboard musical instrument. Numeral 2 denotes a metallic or plastic balance rail which is directly mounted on the chassis 1. At a fulcrum 4 of the balance rail 2, a wooden key 3 which is provided with a weight 21 for giving an inertia is swingably supported. The depressed key 3 is returned by a returning means 5. An actuator 6 of a screwed construction is mounted by screwing in front of the fulcrum of the key 3. A switch 7 to determine the timing at which the sound is started (or generated) is provided on the chassis 1. When the key 3 swings by a depression with a finger at its front portion, the actuator 6 pushes the switch 7 to start generating a sound. The returning means 5 is made up of a plastic lever 9 which is swingable about a lever fulcrum 8 supported by the chassis 1, a lead lever weight 10 to apply an inertia to the key 3, and a spring 11. By pushing the rear end of the key 3 with the front end of the lever 9, a force for returning the key 3 from the depressed position is provided.

Figures 5, 6A, 6B, 6C:
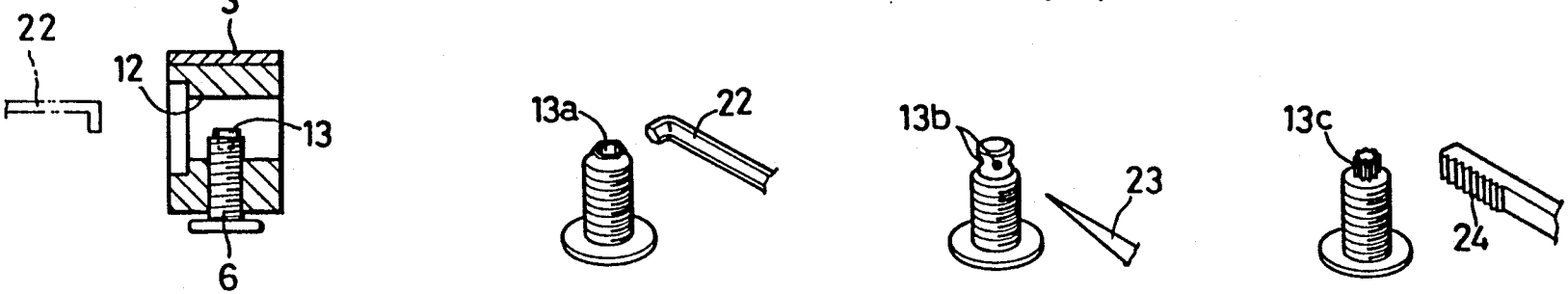
FIG. 5 is a sectional view taken along the line 5—5 of FIG. 4.
FIGS. 6(A), (B), and (C) are perspective views of actuators according to the present invention.

A lateral actuator adjusting window 12 is formed in front of the fulcrum 4 of the key 3 in the width direction thereof such that it does not impair the external appearance of the key 3. The actuator 6 is mounted by means of screwing within the adjusting window 12 such that an adjusting engagement portion 13 provided at the tip of the actuator 6 is exposed therethrough. The adjusting engagement portion 13 may, for example, be made with a hexagonal hole 13*a* to engage with a hexagonal wrench 22 as shown in FIG. 6(A), a plurality of small round holes 13*b* to engage with a shaft 23 as shown in FIG. 6(B) or with a gear 13*c* to engage with a rack bar 24 as shown in FIG. 6(C).

Numeral 14 denotes a front pin which is fixed by a screw 34 to a wooden key frame front rail 15 and which extends upwards through the keyboard chassis 1. The key frame front rail 15 is directly mounted by means of screwing on the face opposite to the key 3, i.e., on the bottom face of the keyboard chassis 1. The front pin 14 is provided such that it extends into a concave hole 14*a* formed in the key 3. The front pin 14 guides the key 3 so that it swings without laterally fluctuating. With such construction, even if a deformation occurs to the key frame front rail 15 due, for example, to poor fabrication accuracy and to the relative humidity, the deformation will not be transmitted to the key 3. In other words, deformations in the key frame front rail 15 will not vary the swinging distance of the key 3. The swinging movement of the key 3 towards the returning direction is restricted by a stopper 17 which is provided at the rear of the key 3. The swinging movement of the lever 9 which swings together with the key 3 is restricted by a lever stopper cushion 18 which is mounted on the keyboard chassis 1. Further, in order to restrict the swinging of the key 3, there are provided a felt member 19 in a front lower portion of the key 3 and a key stop 20 of felt make in an upper intermediate portion of the key 3.

The balance rail 2 to support the key 3 is made of metal or plastic and is directly mounted to the metal keyboard chassis 1. Therefore, the position of the fulcrum 4 is not subject to misalignment even under environmental changes such as in the relative humidity. In addition, since the fabrication accuracy of the balance rail 2 is remarkably better than a conventional wooden one, a slight adjustment to the actuator 6 is all that will normally be necessary. This reduces the adjustment work before shipment.

Figure 7:
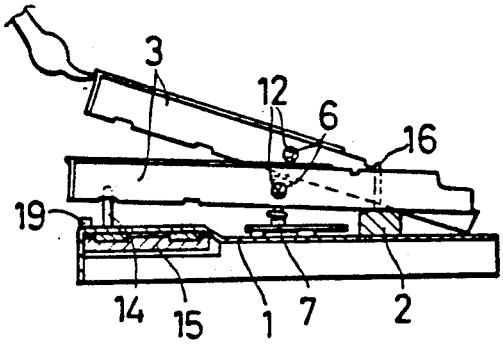
FIG. 7 is an explanation diagram showing the condition of adjusting the actuator.

In case the timing for the actuator 6 to push the switch 7 has become out of tune, the front portion of the key 3 is lifted as shown in FIG. 7 so that the actuator adjusting window 12 is located above the keyboard surface. Then the hexagonal wrench 22 or other adjustment tool is inserted through the actuator adjusting window 12 to engage with the engaging portion 13 as shown in FIG. 5. After that, adjustment of the timing can be easily carried out by turning the actuator 6 to regulate the distance of projection out of the key 3. The adjusting window 12 is formed, as shown in FIG. 5, by laterally penetrating the key 3 at a position sufficiently forward of the fulcrum 4 of the key 3. The actuator 6 is provided by screwing right from the bottom of the adjusting window 12 and the switch 7 is arranged to be located directly below the actuator 6.

Figure 8:
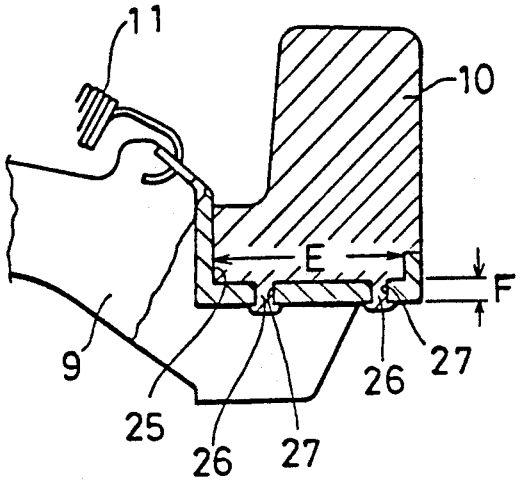
FIG. 8 is an enlarged sectional view of the mounting portion of a lever weight.
Figure 9:
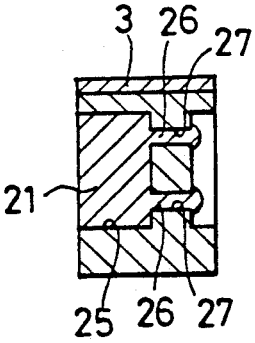
FIG. 9 is an enlarged sectional view taken along the line 9—9 of FIG. 4.

Each of the inertia applying members comprising the lever weight 10 and the key weight 21, which are provided to give inertia to the wooden key 3, is at least partially fittingly contained in a box 25 as shown in FIGS. 8 and 9. The box 25 is provided in a mounting member (i.e., a member on which the inertia applying member is mounted) which is in the form of the key 3 and the lever 9 as shown in FIGS. 8 and 9, respectively. Further, a plurality of projections 26,26 is provided on each inertia applying member and project out of a plurality of through holes 27,27 provided in the corresponding box 25, and the projections 26,26 are deformed at the outside of the box 25. Through such construction, the inertia applying member is fixed to the mounting member in such a manner that it will not become loose due to the temperature changes, as discussed further below.

FIG. 8 shows the details of mounting the inertia applying member of the lever weight 10 to the mounting member in the form of the lever 9, while FIG. 9 shows the details of mounting the inertia applying member comprising the key weight 21 to the mounting member in the form of the key 3.

With the swinging of the mounting members in the form of the key 3 and the lever 9, the inertia applying members comprising the key weight 21 and the lever weight 10 are also swung. Each of the inertia applying members is, however, fittingly contained in the boxes 25 provided on the mounting members. A plurality, e.g., 2, of projections 26,26 which extend through a plurality, e.g., 2, of through holes 27,27 are fixed to the box 25 after due deformation. In case of the example shown in FIG. 8, when the dimension E of the lever weight 10 shortens due to temperature changes, the dimension F of the projections 26,26 also shortens simultaneously. The lever weight 10 is therefore firmly fixed to the lever 9 at the projections 26. When the dimension E of the lever weight 10 increases, the fitting of the lever weight 10 into the box 25 becomes firmer. Therefore, it becomes possible to always firmly hold the lever weight 10 to withstand the temperature changes, and abnormal vibrations during swinging cease to be generated. This operation also applies in the example shown in FIG. 9.

Figure 4:
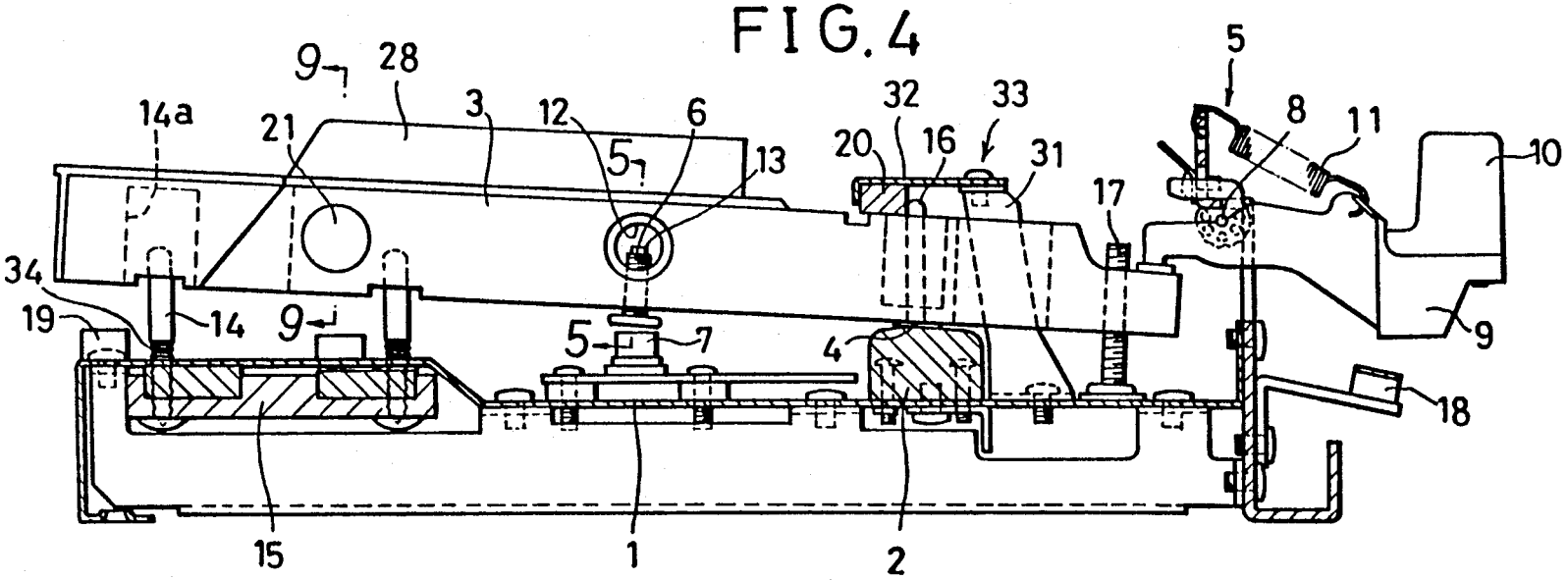
FIG. 4 is a side view, partly in section, of a preferred embodiment of this invention.
Figure 10A:
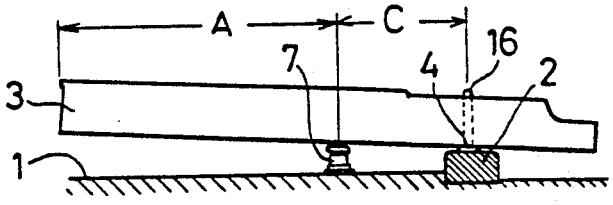
FIGS. 10*a*, 10*b* are explanation diagrams of fulcrums of the black key and the white key of the embodiment of this invention.
Figure 10B:
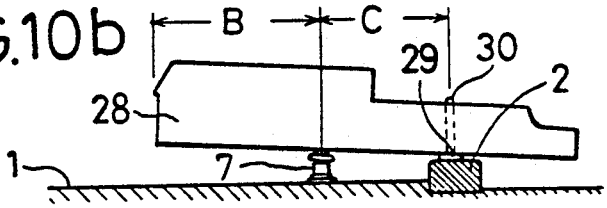

In the above explanations, the key 3 is a white key and the black key 28 is provided in an inner side of the white key 3 as shown in FIG. 4. Referring to FIGS. 10*a*, 10*b*, black key 28 is supported by a fulcrum 29 which is provided at an inner side of the fulcrum 4, in line there-with, of the white key 3. The fulcrum 29 is made up of the balance rail 2 and a pin 30. Although not illustrated, the black key 28 is also provided with an actuator and a returning means in the same manner as the white key 3.

By arranging the fulcrums of the white key 3 and of the black key 28 in the same line, as shown in FIGS. 10*a*, 10*b*, the length in front of the fulcrum 29 of the black key 28 becomes B+C, which is shorter than the conventional length. Since a larger force is consequently required for depressing the black key 28, the mass feeling of the black key 28 increases and approaches that of the white key 3. In addition, the distance between the fulcrum 29 and the switch 7 becomes shorter to be the same distance as that of the white key 3. The switch actuation ratio (the distance at which the key 3 must be swung to actuate the switch 7) becomes nearer to that of the white key 3, and the springing feeling generated by the switch is reduced. Since the pins 16, 30 are arranged in the same line on the balance rail 2, the fabrication of the fulcrum becomes easier.

Figure 11A:
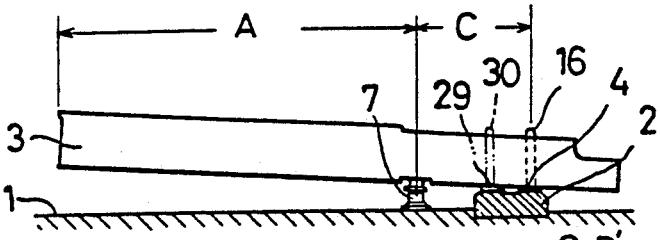
FIGS. 11*a*, 11*b* are substantially similar to FIGS. 10*a*, 10*b*, but show a modification of fulcrums of the black key and the white key of the embodiment of the invention.
Figure 11B:
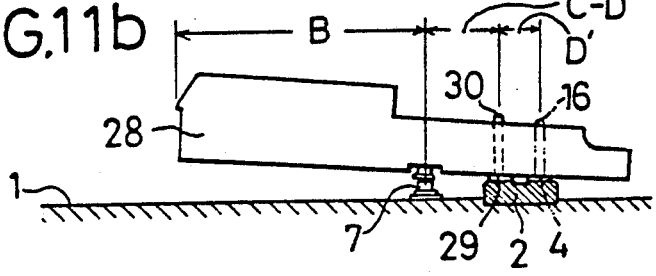

As a possible modification, the fulcrum 29 of the black key 28 can be arranged in front of the fulcrum 4 of the white key 3, as shown in FIGS. 11*a*, 11*b*. In this case, the distance in front of the fulcrum 29 is B+C−D' and, therefore, the feeling of the mass of the black key 28 as well as the switch actuation ratio further approach those of the white key 3.

The felt key stop 20 which is provided to prevent the white key 3 and the black key 28 from swinging upwards, is mounted on fixing legs 33. Each of the fixing legs 33 is made up of a support column 31, the root portion of which is fixed to the keyboard chassis 1 towards the rear of the fulcrum 4, and an extension plate 32 which extends from the upper end of the support column 31 towards the front of the fulcrum 4 so that the upper portion of the key 3, 28 in front of the fulcrum 4 is normally pressed by the key stop 20. In this manner, when the key 3, 28 is swung downwards, the key stop 20 is not pressed into deformation by that rear portion of the key which is urged upwards. The feeling generated at the time of touching the key is therefore not impaired. In addition, since the key stop 20 can be mounted close to the upper surface of the key, the space above the keyboard can be made smaller, and the keyboard can be contained in a compact manner. As shown in FIG. 4, the support column 31 of the fixing leg 33 extends upward through an opening (indicated by dotted lines) defined in the key.

OPERATION OF KEYBOARD

In operation the key 3, 28 swings about the fulcrum 4, 29 on the balance rail 2 which is mounted to the keyboard chassis 1. The key is returned from its depressed position to its home (undepressed) position by means of a returning means 5. In case of an electronic musical instrument, the actuator provided in the key controls, at the time of swinging, the operation of the switch which determines the start of sounding. The balance rail to support the key is made of metal or plastic which can be precision-fabricated, and is less liable to deformation due to the changes in ambient conditions as compared with a conventional wooden balance rail. In addition, since the balance rail is mounted on the metallic keyboard chassis, the deformation becomes less liable to occur. Thus, the frequency of adjustment of a keyboard according to the invention can be reduced in comparison to conventional keyboards both during and after assembly of the keyboard.

When adjustment of the actuator 6 is to be carried out for adjusting the start of sounding, the key is lifted and a wrench, for example, is inserted through the actuator adjusting window 12 at the side of the key. In this way, it is possible to make an adjustment by rotating the actuator by engaging the wrench 22 with the adjusting engagement portion 13 at the tip of the actuator. Since the actuator adjusting window is provided on the side of the key, at which the beauty of the surface of the keyboard is not imparied, the actuator can be positioned a large distance away from the fulcrum of the key. Therefore, an adjustment can be performed by moving the actuator significantly upwardly of its normal position, resulting in an easier adjustment work.

ADVANTAGES OF THE INVENTION

As described above, according to this invention, in the keyboard apparatus for the keyboard musical instrument in which the wooden key is used, the metallic or plastic balance rail is directly mounted on the metallic keyboard chassis and the wooden key is arranged to be supported by the balance rail. Consequently, the misalignment of the fulcrum due to changes with the lapse of time or to ambient changes is less likely to occur. In addition, since the assembly accuracy improves, there is an effect in that the adjustment work is reduced during assembly also.

Further, each key is provided with a lateral actuator adjusting window such that the actuator is mounted by screwing, with the engaging portion at the tip of the actuator exposed through the window. Also, the actuator can be provided at a large distance in front of the fulcrum of the key because it will not affect the appearance of the key. Therefore, the adjustment of the actuator can be performed easily by lifting the key and then simply rotating the actuator tip 13 with an appropriate tool.

Also, the mounting assembly for the inertia applying members 10, 21 is provided with the box 25 and at least part of the inertia applying member is fittingly contained into the box, the projections 26 projectingly formed on the inertia applying members are made to project out of the through holes 27 in the box, and the inertia applying members are fixed to the mounting member by deforming the tips of the projections. Therefore, the inertia applying members can be prevented from becoming loose under temperature changes, thus eliminating abnormal vibrations during swinging of the key.

Additionally, the key frame front rail 15 on which the front pin 14 to guide the key 3, 28 is mounted, is fixed to that side of the keyboard chassis which is opposite to the key, and the front pin 14 is extended into the key through the chassis. Therefore, even if the key frame front rail is deformed due to the environmental changes or to the misalignment in the fabrication accuracy, the deformation is developed towards the bottom side of the chassis and does not happen to the direction of the key. Consequently, the swinging distance of the key is accurately maintained and the wrong timing of generating a sound or failure to operate due to the deformation of the key frame front rail can be prevented.

Still further, by positioning the fulcrum of the black key in the same line as, or in front of, the fulcrum of the white key, the feeling of mass of the black key increases. The switch actuation ratio of the black key becomes closer to that of the white key, and the feeling generated at the time of touching the key can be improved. By arranging the fulcrums in the same line, their manufacturing can be simplified.

Further yet, the key stop is mounted on the front tip of the supporting leg which is provided to extend forward from behind the fulcrum of the key. Therefore, it is possible to eliminate the disadvantage in that the key deforms the key stop when the key is depressed. As a result, the feeling generated at the time of touching the key is improved. In addition, since that space above the key which is required for the key stop is reduced, the keyboard can be contained in a compact manner, bringing about the effect of more freedom in the design.

Although there has been described what is at present considered to be the preferred embodiment of the present invention, it will be understood that the invention can be embodied in other specific forms without departing from the spirit or essential characteristics thereof. The described embodiment is, therefore, to be considered in all aspects as illustrative and not restrictive. The scope of the invention is indicated by the appended claims rather than by the foregoing description.

We claim:

1. A keyboard apparatus for an electronic keyboard musical instrument which is provided with a switch to determine a timing at which a sound is started, said apparatus comprising a wooden key swingably supported at a fulcrum on a metallic keyboard chasis and which is returned from its depressed position by returning means, wherein:

a balance rail made of at least one of plastic and metal is provided on said metallic keyboard chassis; and said wooden key is directly supported on said balance rail.

2. A keyboard apparatus for an electronic keyboard musical instrument according to claim 1, including:

a metallic pin fixed to said balance rail;

said balance rail being made of plastic; and said wooden key being swingably supported on said balance rail.

3. A keyboard apparatus for an electronic keyboard musical instrument according to claim 1, wherein:

said switch actuates sounding of said electronic keyboard musical instrument provided on said keyboard chassis; and said keyboard apparatus further includes:

an actuator of screwed construction is screwed to said key in front of said fulcrum of said key, said actuator being adapted to push said switch by swinging movements of said key;

an actuator adjusting window defined in said key in the width direction thereof;

an engaging portion for adjustment provided at a tip portion of said actuator;

said actuator being mounted by screwing from the bottom portion of said key such that the tip portion of said actuator is exposed through said adjusting window.

4. A keyboard apparatus for an electronic keyboard musical instrument according to claim 3, wherein a polygonal hole is provided at the tip surface of said actuator of screwed construction to form said engaging portion for adjustment.

5. A keyboard apparatus for an electronic keyboard musical instrument according to claim 1, including:

an inertia applying member for applying inertia to said key;

a box provided on a mounting member for said inertia applying member, said box containing at least part of said inertia applying member;

a plurality of projections formed on said inertia applying member;

a plurality of through holes provided in said box such that said projections project out of said box;

those portions of said projections which project outside said box through said through holes being deformed, thereby fixing said inertia applying member to the inside of said box.

6. A keyboard apparatus for an electronic keyboard musical instrument according to claim 1, including:

a front pin provided on a key frame front rail in front of said fulcrum to prevent said key from laterally fluctuating during swinging thereof;

said key frame front rail being fixed to that side of said keyboard chassis which is opposite to said key;

said front pin being extended into said key through said chassis.

7. A keyboard apparatus for an electronic keyboard musical instrument according to claim 1, comprising:

more than one said wooden key, including a plurality of white keys and a plurality of black keys;

an inertia applying member for applying an inertia provided on each said key; and a fulcrum of each of said black keys provided in line with a fulcrum of each of said white keys.

8. A keyboard apparatus for an electronic keyboard musical instrument according to claim 1, comprising:

more than one said wooden key, including a plurality of white keys and a plurality of black keys;

an inertia applying member for applying an inertia provided on each said key; and a fulcrum of each of said black keys is provided forwardly of a fulcrum of each of said white keys.

9. A keyboard apparatus for an electronic keyboard musical instrument according to claim 1, including:

a fixing leg provided on said keyboard chassis, said fixing leg extending upwardly through an opening defined in said key and further extending above said key from behind a rear of said fulcrum of said key towards a front portion of said fulcrum; and a key stop provided at a front tip of said fixing leg to prevent said key from swinging upwards.

* * * * *

UNITED STATES PATENT AND TRADEMARK OFFICE

CERTIFICATE OF CORRECTION

PATENT NO. : 5,079,985

DATED : January 14, 1992

INVENTOR(S) : Yamaguchi et al.

It is certified that error appears in the above-identified patent and that said Letters Patent is hereby corrected as shown below:

Column 9, line 48 (claim 3, line 7), please delete "is".

Signed and Sealed this

First Day of June, 1993

*Attest:*

Michael K. Kirk

MICHAEL K. KIRK

*Attesting Officer*

*Acting Commissioner of Patents and Trademarks*